US005781107A

United States Patent [19]

Ji

[11] Patent Number: 5,781,107

[45] Date of Patent: Jul. 14, 1998

[54] ALARM DEVICE FOR AUTOMATIC GARAGE DOOR

[76] Inventor: Wen Shu Ji, 7303 Toll Dr., Rosemead, Calif. 91770

[21] Appl. No.: 697,685

[22] Filed: Aug. 29, 1996

[51] Int. Cl.[6] ..... G08B 13/08

[52] U.S. Cl. ..... 340/545; 340/522

[58] Field of Search ..... 340/545, 522

[56] References Cited

U.S. PATENT DOCUMENTS

| | | | |
|---|---|---|---|
| 4,074,269 | 2/1978 | Hartley | 340/545 |
| 4,464,651 | 8/1984 | Duhame | 340/522 |
| 4,583,081 | 4/1986 | Schmitz | 340/545 |
| 5,402,105 | 3/1995 | Doyle et al. | 340/545 |

*Primary Examiner*—Glen Swann

*Attorney, Agent, or Firm*—David & Raymond; Raymond Y. Chan

[57] ABSTRACT

An alarm device for an automatic garage door includes a detecting circuit for producing a single negative pulse signal when a detector detects an opening motion of said garage door, an alarm controlling circuit for receiving said single negative pulse signal and producing an alarm signal, a "normal function" detecting circuit connecting to a garage door opening machine for producing a "normal opening" signal when said garage door is normally opened by said garage door opening machine, which is then changed to a "shut off alarm" signal provided to said alarm controlling circuit for preventing the production of said alarm signal, an alarm generating circuit for generating an alarm when said alarm signal is received, and a transformer circuit for providing low voltage for said alarm device. Accordingly, the alarm device for an automatic garage door can provide a warning alarm when said garage door is forced to open or damaged by bandits or burglars. However, as long as the residents operate a normal remote control or in-house switch of said garage door to open or close it, said garage door will be opened and closed as usual (with no alarm).

25 Claims, 4 Drawing Sheets

ALARM DEVICE FOR AUTOMATIC GARAGE DOOR

BACKGROUND OF THE PRESENT INVENTION

The present invention relates to an alarm system, and more particularly to an alarm device for an automatic garage door, which can provide alarm sound or other alarm signals when the garage door is forced to open by bandits or burglars. However, when the residents normally operate the remote control or the in-house switch of the garage door to open or close the garage door, it will be opened and closed as usual.

Currently, more and more families install home use alarm system in order to scare away the bandits or burglars and to provide alarm signals once the burglar breaks into the house. However, it is a well known matter for most experienced burglars or bandits that it is no need for them to break in a traditional U.S. house through the usual doors or windows. The bandits or burglars can simply enter a house by forcing the garage door to open or even destroying it because the garage is always an easy passage to the interior of the house. It is because the alarm companies usually do not set up detecting device in the garage door. In other words, the alarm system installed at home does not monitor the garage. This is an unsolved technical and operational problem to many alarm companies.

The common alarm system can merely work to provide buzzing alarm sound when all the doors and windows in house are well shut. Therefore, when the residents leave their house, they must close all the doors and windows and then set the alarm system to function by means of an alarm controlling board. At that moment, the alarm system provides 60 to 120 seconds delay for the residents to rush out of the house and close up the door. If such traditional alarm system is installed in the garage, the residents should quickly complete the following procedures once they activate the alarm system.

1. Open the garage door immediately.
2. Start the engine of the car as soon as possible, however most of the cars need a certain period of time to warm up, especially in winter season.
3. Drive or even back up the car out of the garage.
4. Close the garage door promptly.

To those young residents, it still exists some difficulties to complete the above four continuous steps within such relatively short period of time. To those seniors and women, it is not only extremely difficult to complete the above four steps within only 60 to even 120 seconds, but also that they will feel dangerous and too nervous while they have to drive out of the garage.

In fact, 90% of residents usually do not activate the alarm system when they are at home. However, most of the burglars break in the house through the garage door in the dead of night. Moreover, the conventional alarm system requires a secret code or key to input every time by the residents when they turn on or shut off the alarm system. This is very inconvenient to the aged residents who usually have the problem of memory.

In the current market, there is a type of automatic floor lock. Unfortunately, such kind of floor lock is limited to install on a plank garage door and incompatible with the most popular rolling garage door. Moreover, the plank garage door may be affected by weather, that sometimes the lock pole can not fit into the lock hole. Consumers have to check the lock by themselves frequently and call the installation company for an adjustment periodically. In fact, if any kind of lock can scare away the bandits or burglars, nobody needs to install alarm system.

SUMMARY OF THE PRESENT INVENTION

The main object of the present invention is to provide an alarm device for an automatic garage door, which can generate alarm sound or other alarm signals when the garage door is forced to open or damaged by bandits or burglars. However, as the residents normally operate the remote control or in-house switch of the garage door to open or close it, the garage door will be opened and closed as usual.

Another object of the present invention is to provide an alarm device for an automatic garage door, which not only can be equipped with an automatic garage door opening system of various new or old types, but also can be incorporated with the garage doors having different opening methods.

Another object of the present invention is to provide an alarm device for an automatic garage door, which does not require any additional switch device for the garage door and can fully adapt its automatic switches. The present invention can provide security for your garage door and prevent unwanted people's entering your garage 24 hours a day, even in case of shortage of the electric power supply of the house.

Another object of the present invention is to provide an alarm device for an automatic garage door, which is equipped with special connecting terminals and is compatible with all present home-use alarm system. The residents can use their regular remote control of their garage door to open and close the garage door for car driving out or into the garage in a usual manner and without any inconvenience.

Another object of the present invention is to provide an alarm device for an automatic garage door, which also provides a lighting signal indicator connected in house, so that even if the garage door is opened normally by the resident, the indicator flashes to alert the residents to shut off the garage door.

Another object of the present invention is to provide an alarm device for an automatic garage door, which can provide a siren up to 120 db to scare the burglars away.

Accordingly, an alarm device for an automatic garage door of the present invention comprises a detecting circuit, which comprises at least a detector for installing to a garage door of a garage in a usual manner, for producing a single negative pulse signal when the detector detects an opening motion of the garage door, an alarm controlling circuit for receiving the single negative pulse signal and producing an alarm signal, a "normal function" detecting circuit connecting to a garage door "normal operation" signal generating source which is a garage door opening machine for producing a "normal opening" signal when the garage door is normally opened by the garage door opening machine, and that the "normal opening" signal is then changed to a "shut off alarm" signal provided to the alarm controlling circuit for isolating a high voltage of the garage door opening machine to ensure security and preventing the production of the alarm signal, an alarm generating circuit connecting with at least an alarm generator for generating alarm when the alarm signal is received, and a transformer circuit for providing low voltage for the alarm device. The above circuits are electrically connected to form a whole alarm circuit of the alarm device of the present invention.

Moreover, an alarm delay circuit is able to connect between the alarm controlling circuit and the alarm generating circuit for amplifying the alarm signal from the alarm controlling circuit so as to automatically stop the alarm generated by the alarm generator after a predetermined period of alarm time.

In addition, when the detecting signal is transformed to the single and negative pulse signal, the detecting circuit also produces another negative electricity signal to an in-house lighting signal indicator to generate flashing light for indicating the residents that the garage door is unclosed.

DETAILED DESCRIPTION OF THE PREFERRED EMBODIMENT

Figure 1:
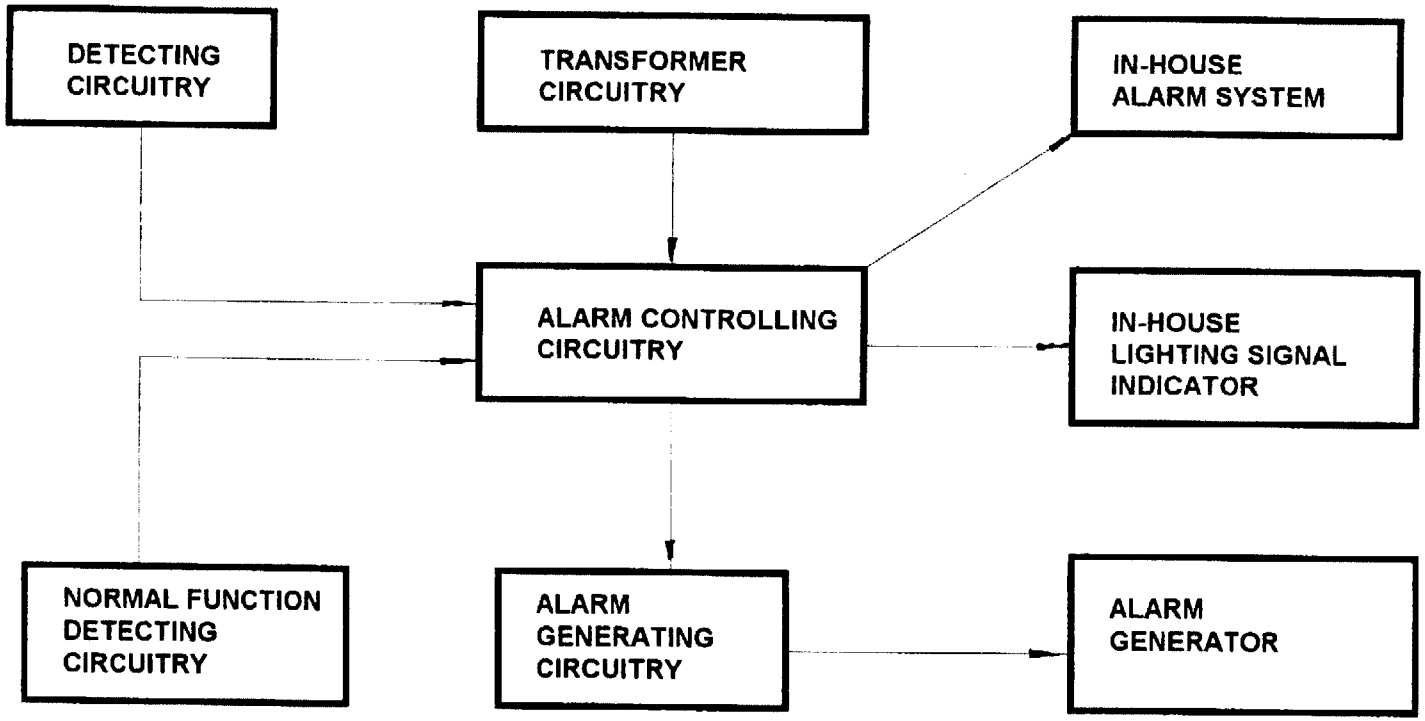
FIG. 1 is an operation block diagram of an alarm device for an automatic garage door according to a first preferred embodiment of the present invention.
Figure 2:
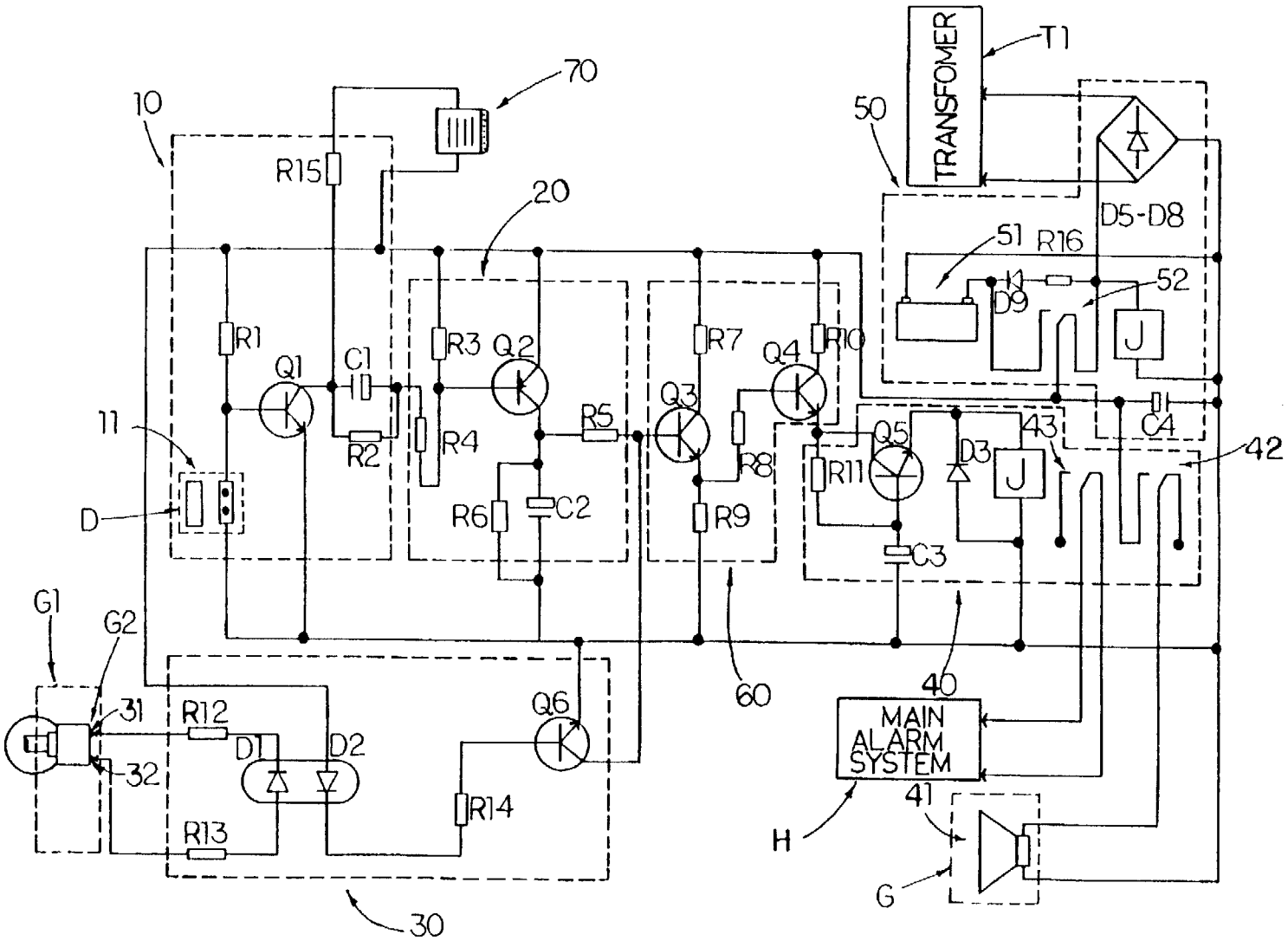
FIG. 2 is a circuit diagram of the alarm device for an automatic garage door according to the above first embodiment of the present invention.

Referring to FIGS. 1 and 2, an alarm device for an automatic garage door of the present invention comprises a detecting circuit 10, an alarm controlling circuit 20, a "normal function" detecting circuit 30, an alarm generating circuit 40, and a transformer circuit 50 electrically connected to form a whole alarm circuit of the alarm device of the present invention.

The detecting circuit 10 comprises at least a detector such as an alarm contact unit 11 installed to a garage door D of a garage in a usual manner for producing a single negative pulse signal when the alarm contact unit 11 detects an opening motion of the garage door D. The alarm controlling circuit 20 for receiving the single negative pulse signal and producing an alarm signal. The "normal function" detecting circuit 30 is connected to a garage door "normal operation" signal generating source which is a garage door D opening machine G1 for producing a "normal opening" signal when the garage door is normally opened by the garage door opening machine G1. The "normal opening" signal is then changed to a "shut off alarm" signal provided to the alarm controlling circuit 20 for isolating a 110 V high voltage of the garage door opening machine G1 to ensure security and preventing the output of the alarm signal. The alarm generating circuit 40 is connected with at least an alarm generator 41 for generating alarm when the alarm signal is received. The transformer circuit 50 is capable of providing a low DC voltage for the alarm device.

Moreover, an alarm delay circuit 60 is connected between the alarm controlling circuit 20 and the alarm generating circuit 40 for extending the alarm signal output from the alarm controlling circuit 20 so as to automatically stop the alarm generated by the alarm generator 41 after a predetermined period of alarm time.

The detecting circuit 10 comprises three resistors R1, R2 and R15, a capacitor C1 and a transistor Q1 electrically connected, as shown in FIG. 2. The resistor R1 is connected to the control terminal of the transistor Q1 which is further connected to the resistor R15. The resistor R2 is connected in parallel with the capacitor C1 which is connected in series with the transistor Q1. The alarm contact unit 11 of the detecting circuit 10 is closed when the garage door D remains closed. At that moment, the connected detecting circuit 10 is grounded via the alarm contact unit for discharging and preventing the function of the transistor Q1 as well as the detecting circuit 10. Therefore, the capacitor C1 is normally grounded and has a zero potential difference, so that the capacitor C1 does not function as long as the capacitor is grounded.

The alarm contact unit 11 is opened and generates a detecting signal when the garage door is opened. At that moment, the ground is removed and the transistor Q1 charges the capacitor C1 once, so as to output the single negative pulse signal for 0.03 second to the alarm controlling circuit 20 while another negative electrical signal is input to an in-house signal indicator 70 which is a super bright LED or a buzzer to generate flashing light or warning sound for indicating the residents that the garage door D is opened. After the capacitor C1 outputs the single negative pulse signal by discharging voltage, the potential difference of the capacitor C1 returns to zero.

The "normal function" detecting circuit 30 consists of three resistors R12, R13 and R14, a transistor Q6 and a photoelectric coupling tube D1 and D2 connected in series with the resistors R12, R13 and R14. The resistor R14 is connected to the control terminal of the transistor Q6. The "normal function" detecting circuit generates a "normal opening" signal when the garage door D is opened normally by the garage door opening machine G1. The garage door opening machine G1 can be activated by a remote control or a manual switch thereof. Two input terminals 31, 32 of the "normal function" detecting circuit 30 are connected to the garage door opening machine G1.

The traditional garage door opening machine G1 is normally connected with at least a lamp G2 which will be activated to provide illuminating light once the garage door D is opened. According to the present embodiment, the two input terminals 31, 32 of the "normal function" detecting circuit 30 are connected to two terminal contacts of the lamp G2. Therefore, once the garage door D is opened by operating the garage door opening machine G1, the "normal function" detecting circuit 30 detects and provides the "shut off" alarm signal to the alarm controlling circuit 20. Moreover, the photoelectric coupling tube D1 and D2 provides the features of preventing any electrical connection between the 110 V high voltage of the garage door opening machine G1 and the low voltage of the alarm circuit of the alarm device, and enabling the "normal function" detecting circuit 30 to be activated through the small current of 0.2–0.3 μA.

Alternatively, the two input terminals 31, 32 of the "normal function" detecting circuit 30 can also be connected to a remote control receiver of the garage door opening machine G1 as the garage door "normal operation" signal generating source. Also, the power switch for the garage door opening machine G1 and the electrical control of the mechanical motion of the garage door opening machine G1 can be treated as the garage door "normal operation" signal generating source by connecting the two input terminals 31, 32 thereto.

The alarm controlling circuit 20 receives and compares the single and negative pulse signal and the "shut off alarm" signal from the detecting circuit 10 and the "normal function" detecting circuit 30 respectively and produces a warning signal to the alarm delay circuit 60 to activate the alarm generator 41 to generate alarm warning sound. In addition, a warning shut off signal is produced from the alarm controlling circuit 20 to control the alarm generator 41 not to function when the garage door is opened in normal way by the garage door opening machine G1 which is activated by the remote control or in-house switch in the garage. Both the producing alarm signal and the "shut off alarm" signal also trigger the alarm delay circuit 60.

The alarm controlling circuit 20 includes four resistors R3, R4, R5, and R6, wherein the resistors R3 and R4 are connected to the control terminal of a transistor Q2 which is further connected to the resistor R5. A capacitor C2 is connected in parallel with the resistor R6 to form a time delay means which is connected in series with the transistor Q2. The alarm controlling circuit 20 is connected with the detecting circuit 10 by connecting the resistor R4 in series with the capacitor C1.

When the garage door is forced to open by a burglar, the garage door opening machine G1 is not activated, so that the "normal function" detecting circuit 30 is an open circuit and does not function. At that moment, the single negative pulse signal is input to the alarm controlling circuit 20. The capacitor C2 gradually discharges electricity to the alarm generating circuit 40 via the alarm delay circuit 60 so as to generate the warning signal to activate the alarm generating circuit 40 and constitute a delay function for controlling the predetermined alarm period of the alarm generated by the alarm generator 41.

When the garage door is opened by the garage door opening machine G1 by the resident, the "normal function" detecting circuit 30 which is connected to the output of the time delay means of the alarm controlling circuit 20 becomes a closed circuit. At this moment, the capacitor C2 discharges electricity to the "normal function" detecting circuit 30, so that the production of the warning signal to the alarm generating circuit 40 is prevented. Thus, no alarm will be generated.

The alarm delay circuit 60 is connected between the alarm controlling circuit 20 and the alarm generating circuit 40 for extending the warning signal when a small capacitor is used as the capacitor C2 for reducing cost and size. Of course, if a relatively large capacitor is used as the capacitor C2, the alarm delay circuit 60 can be omitted and the alarm controlling circuit 20 is directly connected with the alarm generating circuit 40.

The alarm delay circuit 60 is a warning time control which assists the alarm controlling circuit 20 with an auto-stop function so as to enable the warning alarm sound activated by the alarm generating circuit 40 to automatically stop after a predetermined period of alarm time. The alarm period can be adjusted via the alarm delay circuit 60 from 3 to 5 minutes.

The alarm delay circuit 60 comprises four resistors R7, R8, R9, and R10 and two transistors Q3 and Q4, wherein the resistor R5 is connected to the control terminal of the transistor Q3 which is connected with the resistors R7 and R9. The transistor Q3 is connected in parallel with the transistor Q4 which is connected in series with the resistors R8, R10 of the alarm delay circuit 60 and a resistor R11 of the alarm generating circuit 40.

The alarm generating circuit 40 has a function of two second delay to prevent being interfered by the alarm controlling circuit 20 when it produces the warning signal thereto every time. After the two second delay, a switch of the alarm controlling circuit 20, connecting to the alarm generator 41, is switched on to activate the alarm generator 41 to provide the warning alarm. If the alarm generator 41 is an independent alarm generator such as a buzzer installed in the garage, the switch is a normally opened switch 42 which is activated to close so as to activate the alarm generator 41 to generate alarm sound. Of course, we can utilize those alarm generators of the traditional alarm system installed in house by electrically connecting the alarm generating circuit 40 of the alarm device of the present invention to the alarm system in-house. Then the switch is a norinally opened switch 43 which is activated to open so as to activate the in-house main alarm system.

According to the present embodiment, the alarm generating circuit 40 comprises the normally opened switch 42 connected to the independent alarm generator 41 which is installed in the garage G and a normally closed switch 43 connected to the in house main alarm system H. Therefore, when the alarm generating circuit 40 is activated by the warning signal which is produced from the alarm controlling circuit 20 and extended by the alarm delay circuit 60, the alarm generator 41 installed in the garage G is activated to generate alarm sound. Also, the inhouse main alarm system H is simultaneously activated to awake the residents at home.

The transformer circuit 50 receives a power source of 12 VAC from a transformer T1, which transforms the in-house 110 VAC power source to 12 VAC and provides 12 VDC voltage for the entire alarm circuit to function by connecting with the alarm generating circuit 40. The transformer circuit 50 includes a quad (D5–D8) functioning as a nectifier for converting the 12 VAC to 12 VDC. The transformer circuit 50 further comprises a 12 VDC battery 51 and a control switch 52 which is normally connected with the quad (D5–D8). Therefore, once the house loses its power supply, the control switch 52 switches to connected with the battery 51 automatically for providing a constant DC current from the battery 51 to maintain the "normal function" of the alarm device of the present invention.

Figure 3:
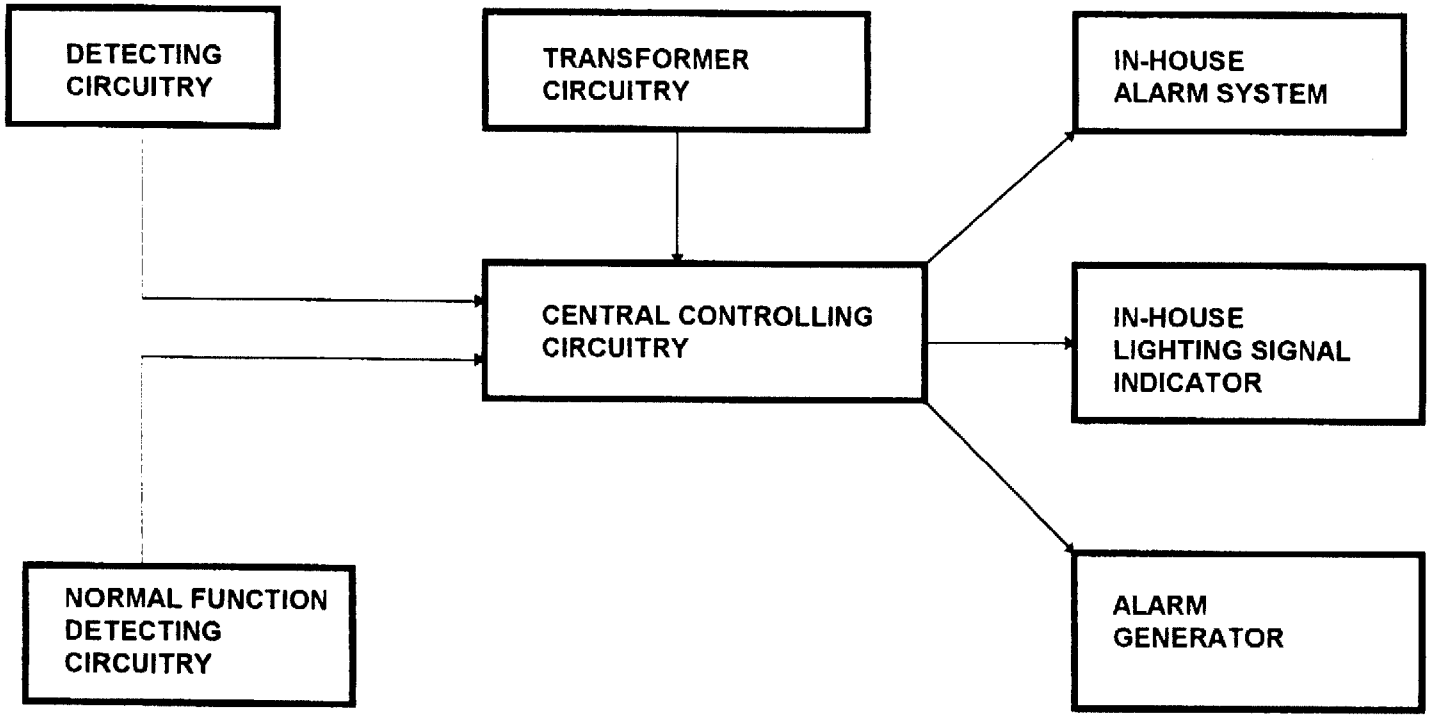
FIG. 3 is an operation block diagram of an alarm device for an automatic garage door according to a second preferred embodiment of the present invention.
Figure 4:
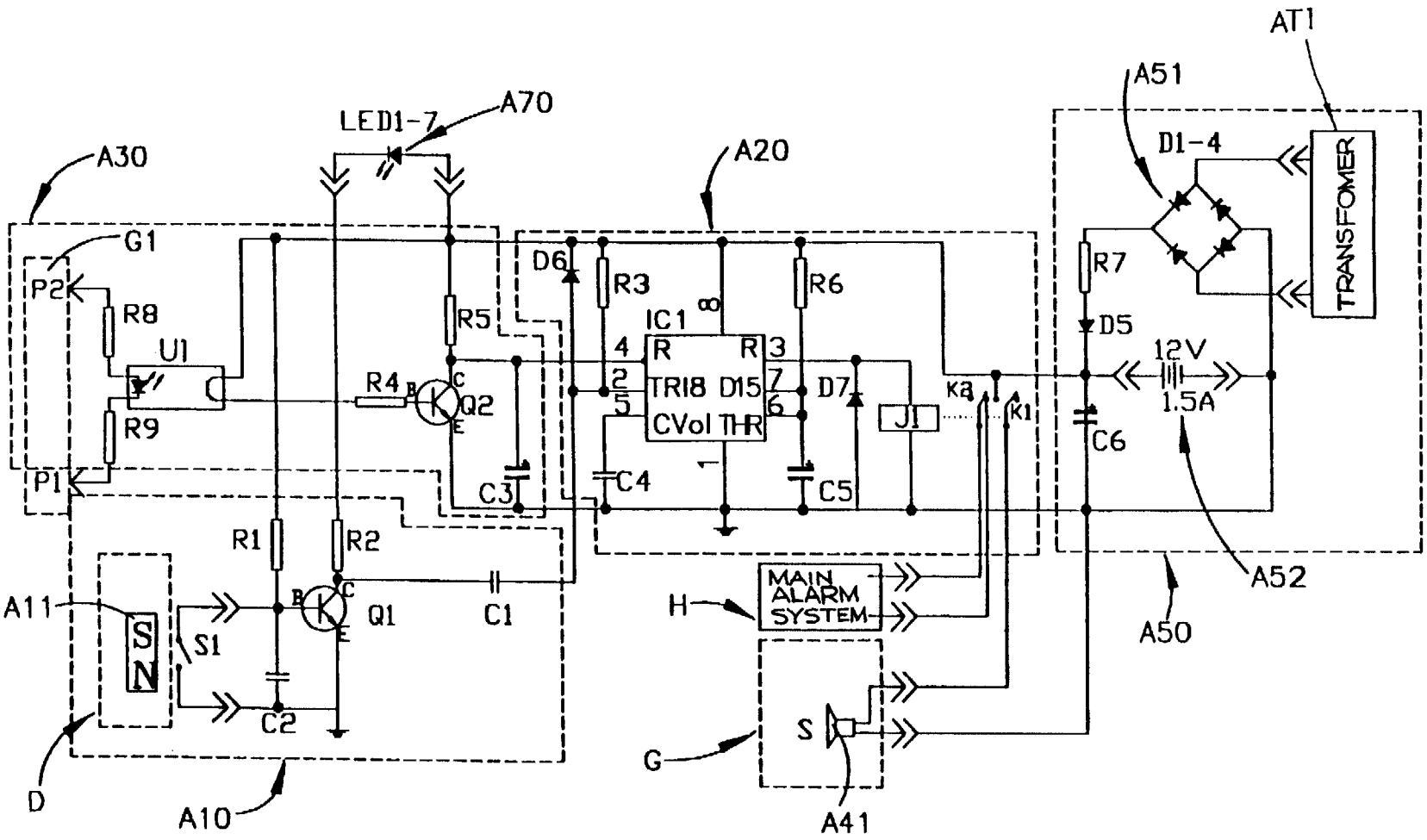
FIG. 4 is a circuit diagram of the alarm device for an automatic garage door according to the above second embodiment of the present invention.

Referring to FIGS. 3 and 4, a second preferred embodiment of the alarm device for an automatic garage door of the present invention is illustrated. The alarm device comprises a detecting circuit A10, a central controlling circuit A20 which is a combination circuit of the alarm controlling circuit 20, the alarm generating circuit 40 and the alarm delay circuit 60 of the previous first embodiment, a "normal function" detecting circuit A30, and a transformer circuit A50.

The detecting circuit A10 comprises at least a detector A11 such as an alarm contact unit installed to a garage door D of a garage in a usual manner for producing a single negative pulse signal when the detector A11 detects an opening motion of the garage door D. The "normal function" detecting circuit A30 is connected to a garage door "normal operation" signal generating source which is a garage door opening machine G1 for producing a "normal opening" signal when the garage door D is normally opened by the garage door opening machine G1. The "normal opening" signal is then changed to an alarm inhibit signal provided to the central controlling circuit A20 for isolating a 110 V high voltage of the garage door opening machine G1 to ensure security and inhibiting the output of the alarm signal.

The central controlling circuit A20 comprises a specified integrated circuit IC1, which is an integrated circuit NE-555 or MC-1555 of the alarm controlling circuit 20, the alarm delay circuit 60 and the alarm generating circuit 40 of the first embodiment as disclosed above, for receiving the single negative pulse signal and producing a continuous positive potential difference for 3–5 minutes to activate a relay J1 to connect with at least an alarm generator A41. The alarm generator A41 is an independent alarm generator installed in the garage G for generating alarm when the alarm signal is received, so that the alarm generated by the alarm generator A41 will be stopped automatically after a predetermined period of alarm time.

The detecting circuit A10 comprises a magnetic control switch S1, a transistor Q1, two capacitors C1, C2, two resistors R1, R2 electrically connected, as shown in FIG. 4. A terminal C of the transistor Q1 is connected with the resistor R2 and the capacitor C1. The resistor R2 further connects to an in-house signal indicator A70 which is a super bright LED or a buzzer installed inside the resident house. A terminal B of the transistor Q1 is connected with the resistor R1 and the capacitor C2 which is connected in parallel with the magnetic control switch S1. A terminal E of the transistor Q1 is grounded. When the garage door D is opened, the alarm contact unit A11 opens and generates a detecting signal. At that moment, the transistor Q1 provides a continuous potential difference to charge the capacitor C1 once, so as to output the single negative pulse signal via the capacitor C1 for a predetermined period of alarm time, such as 0.03 second, to the central controlling circuit A20 while another negative electrical signal is input to the in-house signal indicator A70 to generate a warning light for alerting the residents that the garage door D is opened. Also, after the capacitor C1 outputs the single, negative pulse signal and the potential difference of the capacitor C1 is discharged to zero.

The "normal function" detecting circuit A30 comprises a photoelectric coupler U1 which receives an AC or DC signal and provides a feature of isolating high voltage and low voltage, a transistor Q2, a capacitor C3 for anti-interference, and four resistors R4, R5, R8, R9. Two input ends of the photoelectric coupler U1 are connected in series with the resistors R8, R9 and two terminals P1, P2 respectively. The two output ends of the photoelectric coupler U1 are connected in series with the resistor R4 which is further connected to a terminal B of the transistor Q2. The resistor R5 connects to a terminal C of the transistor Q2 and the in-house signal indicator A70. The capacitor C3 is connected to both the terminal C and a terminal E of the transistor Q2. The two terminals P1, P2 can be connected to the garage door "normal operation" signal generating source, such as the power source circuit, the remote control circuit or the automatic illuminating light circuit of the garage door opening machine G1. Therefore, once the garage door D is normally opened by operating the garage door opening machine G1, the "normal function" detecting circuit A30 detects same and outputs the alarm inhibit signal to the central controlling circuit A20. Moreover, the photoelectric coupler U1 prevents any electrical connection between the 110 V high voltage of the garage door opening machine G1 and the low voltage of the alarm device of the present invention, and enabling the "normal function" detecting circuit A30 to be activated through a small current of 0.2–0.3 μA.

When the garage door D is opened normally by the garage door opening machine G1 which can be activated by a remote control or a manual switch, an AC or DC "normal opening" signal current is received by the photoelectric coupler U1. Then, the photoelectric coupler U1 electrically conducts to the terminal E and terminal C of the transistor Q2 so as to feed a negative electrical signal to a fourth terminal of the integrated circuit IC1 to stop the delay function thereof Therefore, the alarm generator A41 does not provide any warning alarm. Practically, although the detecting circuit A10 is also activated during "normal opening" operation of the garage door D, the detecting circuit A10 is restrained by the "normal function" detecting circuit A30 to avoid the activating of the delay function of the integrated circuit IC1 so that no warning alarm will be provided.

The central controlling circuit A20 further comprises a resistor R3 connected to a second terminal of the integrated circuit IC1 which is an alarm activating terminal. A diode D6 is connected in parallel with the resistor R3 wherein the diode D6 corporates with the resistor R3 to provide an anti-interference function. The relay J1 is connected to a third terminal of the integrated circuit IC1 which is a positive potential difference output terminal after activation for activating the relay J1 to enable the alarm generator A41 to provide warning alarm. A diode D7 is connected in parallel with the relay J1. The fourth terminal of the integrated circuit IC1, which is connected to the terminal C of the transistor Q2, is a negative potential difference input receiving terminal while the garage door D is normally opened in order to prevent an alarm activation from the detecting circuit A10. A capacitor C4 is connected to a fifth terminal of the integrated circuit IC1 to provide an anti-oscillating and anti-bypass effect. A sixth terminal and a seventh terminal of the integrated circuit IC1 are connected to a capacitor C5 and a resistor R6 to provide the delay function for controlling the predetermined alarm period of the alarm generated by the alarm generator A41, wherein when the integrated circuit IC1 is activated, the seventh terminal is blocked and the resistor R6 starts to charge the capacitor C5. When a potential difference between the sixth terminal and the seventh terminal rises to a value equal to two-third of the potential difference of the power source, the seventh terminal electrically conducts for discharging to the capacitor C5 so as to control the warning alarm generated by the alarm generator A41 for 3–5 minutes. A first terminal of the integrated circuit IC1 is grounded and a eighth terminal of the integrated circuit IC1 acts as a VCC positive electricity input terminal.

The central controlling circuit A20 further comprises a normally opened switch K1 which is activated to close by the relay J1 so as to activate the alarm generator A41 to provide alarm sound, and a normally closed switch K2 which is connected with those alarm generators of a traditional in-house main alarm system H installed in home and is activated to open by the relay J1 so as to activate the in-house main alarm system.

The transformer circuit A50 comprises a rectifier A51 constituted by four diodes D1–D4 and connected with a transformer AT1 which transforms the in-house 110 VAC power to 12 VAC, a capacitor C6 connected in series with the alarm generator A41 and a diode D5, a resistor R5 connected in series with the diode D5 and the rectifier A51, and a 1.5 A and 12 VDC rechargeable battery A52 connected in parallel with the rectifier A51. The rectifier A51 rectifies the 12 VAC voltage from the transformer AT1 to 12 VDC voltage for supplying the entire alarm circuit and recharging the 12 VDC rechargeable battery A52. The capacitor C6 is a filter capacitor with high capacity. The rechargeable battery A52 provides temporary power supply for 48 hours of detecting duty life and 1.5 hour of warning alarm life while the main power of the house fails.

When the garage door D is forced to open by a burglar, the garage door opening machine G1 does not be activated so that the "normal function" detecting circuit A30 does not detect any "normal opening" signal. At that moment, the magnetic control switch S1 is in open circuit condition and electrically conducts to the terminal E and terminal C of the transistor Q1. The instantaneously charging capacitor C1 inputs the single negative pulse signal to the second terminal of the integrated circuit IC1 in order to activate the third terminal of the integrated circuit IC1 to produce a positive potential difference to the relay J1 for opening the normally closed switch K2 so as to activate the in-house main alarm system H to provide warning alarm. Since the normally opened switch K1 is connected in parallel with the switch K2, the switch K1 will also be simultaneously activated to close circuit by the relay J1 to activate the alarm generator A41 which is installed in the garage G to provide warning alarm for three to five minutes and then stop automatically.

In accordance with the alarm device for an automatic garage door of the present invention, the following unexpected resulting advantages can be achieved.

1. The alarm device can provide alarm sound both in the garage and inside house when the garage door is forced to open or damaged by bandits or burglars. However, by means of the "normal function" detecting circuit 30, as long as the residents operate the remote control or in-house switch of the garage door to open or close it, the garage door will be opened and closed as usual without generating any warning alarm.

2. The alarm device not only can be equipped with an automatic garage door opening system of various new or old types, but also can be incorporated with garage doors having different opening methods.

3. The alarm device does not require any additional switch device for the garage door and can fully adapt to its automatic switches. The present invention can provide the security of your garage door to prevent unwanted people from entering the garage 24 hours a day, even losing the main electric power supply of the house.

4. The function of the alarm device is reliable, stable, durable, and safe. The residents can use their regular remote control of their garage door to open and close the garage door for car driving out from or into the garage in a usual manner without any inconvenience.

5. The alarm device also provides a lighting or sound signal indicator connected in house, so that even if the garage door is normally opened by the resident, the indicator flashes to remind the resident to shut off the garage door.

6. The alarm device can provide a siren up to 120 db to scare the burglars away but the cost is relatively low.

I claim:

1. An alarm device for an automatic garage door of a garage, comprising a detecting circuit, which comprises at least a detector installed to said garage door, for outputting a single negative pulse signal when said detector detects an opening motion of said garage door;

an alarm controlling circuit, which is electrically connected with said detecting circuit, for receiving said single negative pulse signal from said detecting circuit and producing a warning signal;

a "normal function" detecting circuit connecting to a garage door "normal operation" signal generating source which generates a "normal opening" signal to activate said "normal function" detecting circuit when said garage door is normally opened in a predetermined manner, said "normal opening" signal being then changed to a "shut off alarm" signal provided to said alarm controlling circuit for preventing the production of said alarm signal by said alarm controlling circuit;

an alarm generating circuit connecting with at least an alarm generator for generating a warning alarm when said alarm signal from said alarm controlling circuit is received; and a transformer circuit for providing a low DC voltage for said detecting circuit, said alarm controlling circuit, said "normal function" detecting circuit, and said alarm generating circuit, which are electrically connected to form a whole alarm circuit of said alarm device.

2. An alarm device as recited in claim 1 further comprising an alarm delay circuit connected between said alarm controlling circuit and said alarm generating circuit for extending said alarm signal output from said alarm controlling circuit so as to maintain said warning alarm generated by said alarm generator automatically for a predetermined period of alarm time.

3. An alarm device as recited in claim 1 in which said detector is an alarm contact unit installed to said garage door, which is closed when said garage door remains closed.

4. An alarm device as recited in claim 3 further comprising an in-house signal indicator connecting to said detecting circuit adapted to generate an in-house warning signal when said garage door is opened.

5. An alarm device as recited in claim 4 in which said detecting circuit comprises three resistors (R1) (R2) (R15), a capacitor (C1) and a transistor (Q1) electrically connected, wherein said resistor (R1) is connected to the control terminal of said transistor (Q1) which is further connected to said resistor (R15), said resistor (R2) being connected in parallel with said capacitor (C1) which is connected in series with said transistor (Q1), and wherein said connected detecting circuit is grounded via said alarm contact unit for discharging and preventing the function of said detecting circuit, so that, normally, said capacitor (C1) is grounded, and when said alarm contact unit is opened (when said garage door is opened), said capacitor (C1) is charged so as to output said single negative pulse signal to said alarm controlling circuit while another negative electrical signal is input to said in-house signal indicator to generate a flashing light as said in-house warning signal for indicating that said garage door is unclosed.

6. An alarm device as recited in claim 1 in which said garage door "normal operation" signal generating source is a garage door opening machine, and two input terminals of said "normal function" detecting circuit are connected to said door opening machine for receiving said "normal opening" signal.

7. An alarm device as recited in claim 6 in which said garage door opening machine has a lamp which provides illuminating light when said garage door opening machine is activated to open said garage door, and said two input terminals of said "normal function" detecting circuit are connected to two terminal contacts of said lamp of said garage door opening machine.

8. An alarm device as recited in claim 7 in which said "normal function" detecting circuit comprises three resistors (R12) (R13) (R14), wherein said resistor (R14) is connected to the control terminal of a transistor (Q6), a photoelectric coupling tube (D1) (D2) being connected in series with said resistors (R12) (R13) (R14), for generating a "normal opening" signal when said garage door is opened normally by said garage door opening machine, said photoelectric coupling tube (D1) (D2) being adapted to prevent an electrical connection between a high voltage of said garage door opening machine and the low voltage of said alarm circuit of said alarm device so as to enable said "normal function" detecting circuit to be activated through the small current.

9. An alarm device as recited in claim 8 in which said alarm controlling circuit is adapted to receive said single negative pulse signal and said "shut off alarm" signal from said detecting circuit and said "normal function" detecting circuit respectively, and produce a warning signal to activate said alarm generating circuit for activating said alarm generator to generate alarm warning sound.

10. An alarm device as recited in 9 in which said alarm controlling circuit includes four resistors (R3) (R4) (R5) (R6) wherein said resistors (R3) and (R4) are connected to the control terminal of a transistor (Q2) which is further connected to said resistor (R5), a capacitor (C2) being connected in parallel with said resistor (R6) to form a time delay means which is connected in series with said transistor (Q2), so that said alarm controlling circuit is connected with said detecting circuit by connecting said resistor (R4) in series with said capacitor (C1), whereby when said garage do or is forced to open, said garage door opening machine has not been activated so that said "normal function" detecting circuit is an open circuit and does not function, said single negative pulse signal being input to said alarm controlling circuit, said capacitor (C2) gradually discharging electricity to said alarm generating circuit so as to generate said warning signal to activate said alarm generating circuit and constitute a delay function for controlling said predetermined alarm period of time of said warning alarm generated by said alarm generator, and whereby when said garage door is opened by said garage door opening machine, said "normal function" detecting circuit which is connected to the output of said time delay means of said alarm controlling circuit becomes a closed circuit, said capacitor (C2) discharging electricity to said "normal function" detecting circuit, so that production of said warning signal to said alarm generating circuit is prevented and no alarm is generated.

11. An alarm device as recited in claim 10 in which an alarm delay circuit is connected between said alarm controlling circuit and said alarm generating circuit for extending said warning signal, whereby said alarm delay circuit is a warning time control which assists said alarm controlling circuit with an auto-stop function so as to enable said warning alarm sound activated by said alarm generating circuit to automatically stop after a predetermined period of alarm time.

12. An alarm device as recited in claim 11 in which said alarm delay circuit comprises four resistors (R7) (R8) (R9) (R10) and two transistors (Q3) (Q4), wherein said resistor (R5) is connected to the control terminal of said transistor (Q3) which is further connected with said resistors (R7) and (R9), and that said transistor (Q3) is connected in parallel with said transistor (Q4) and is connected in series with said resistors (R8) and (R10) of said alarm delay circuit and a resistor (R11) of said alarm generating circuit.

13. An alarm device as recited in claim 12 in which said alarm generating circuit has a function of a predetermined period of time delay in order to prevent being interfered with by said alarm controlling circuit when said alarm generating circuit produces said warning signal to said alarm controlling circuit, and whereby after said predetermined period of time delay, a normally open switch of said alarm controlling circuit which is connected to said alarm generator in said garage is activated to close to activate said alarm generator to provide said warning alarm, and whereby said alarm generating circuit further comprises a normally closed switch connected to an in-house main alarm system which is activated to open to activate said in-house main alarm system to provide a simultaneous warning alarm.

14. An alarm device as recited in claim 1 in which said alarm generating circuit has a function of a predetermined period of time delay in order to prevent being interfered with by said alarm controlling circuit when said alarm generating circuit produces said warning signal to said alarm controlling circuit, and whereby after said predetermined period of time delay, a switch of said alarm controlling circuit, connecting to said alarm generator, is switched on to activate said alarm generator to provide said warning alarm.

15. An alarm device as recited in claim 14 in which said predetermined period of time delay of said alarm generating circuit is two seconds.

16. An alarm device as recited in claim 14 in which said alarm generator is an independent alarm generator installed in said garage, and that said switch is a normally open switch which is activated to close so as to activate said alarm generator to provide said warning alarm.

17. An alarm device as recited in claim 16 in which said alarm generating circuit further comprises a normally closed switch connected to an in-house main alarm system, so that when said alarm generating circuit is activated by said warning signal from said alarm controlling circuit, both said alarm generator installed in said garage and said in-house main alarm system are activated to provide a warning alarm.

18. An alarm device as recited in claim 1 in which said transformer circuit receives a predetermined low AC voltage from a transformer which transforms a high voltage of an in-house power source to said low AC voltage and provides a predetermined low DC voltage for said entire alarm circuit to function.

19. An alarm device as recited in claim 18 in which said transformer circuit further comprises a DC battery and a control switch electrically connected, whereby once said in-house power source fails, said control switch connects said battery automatically for providing a constant DC current from said battery in order to maintain a normal function of said alarm device.

20. An alarm device for an automatic garage door of a garage, comprising a detecting circuit which comprises at least a detector installed to said garage door for producing a single negative pulse signal when said detector detects an opening motion of said garage door;

a central controlling circuit which comprises an integrated circuit for receiving said single negative pulse signal and producing an alarm signal for a predetermined period of alarm time, at least an alarm generator which is an independent alarm generator installed in said garage for generating a warning alarm for said predetermined period of alarm time when said alarm signal is received;

a "normal function" detecting circuit connected to a garage door "normal operation" signal generating source which is a garage door opening machine for outputting a "normal opening" signal when said garage door is normally opened by said garage door opening machine, wherein said "normal opening" signal is then changed to an alarm inhibit signal provided to said central controlling circuit for inhibiting the output of said alarm signal, said "normal function" detecting circuit including a photoelectric coupling tube for isolating a 110 V high voltage of said garage door machine from said central controlling circuit; and a transformer circuit for providing a low DC voltage for said detecting circuit, said central controlling circuit and said "normal function" detecting circuit, which are electrically connected to form a whole alarm circuit of said alarm device.

21. An alarm device as recited in claim 20 in which said detecting circuit comprises a magnetic control switch (S1), a transistor (Q1), two capacitors (C1) (C2), and two resistors (R1) (R2) electrically connected, wherein a terminal (C) of said transistor (Q1) is connected with said resistor (R2) and said capacitor (C1), said resistor (R2) further being connected to an in-house lighting signal indicator for installation inside a resident house, a terminal (B) of said transistor (Q1) being connected with said resistor (R1) and said capacitor (C2) which is connected in parallel with said magnetic control switch (S1), a terminal (E) of said transistor (Q1) being grounded, so that when said garage door is opened, said alarm contact unit is opened and generates a detecting signal, at that moment, said transistor (Q1) provides a continuous potential difference to charge said capacitor (C1) so as to output said single negative pulse signal via said capacitor (C1) for a predetermined period of alarm time to said central controlling circuit while another negative electrical signal is input to an in-house signal indicator to generate an in-house warning signal for alerting said residents that said garage door is opened, and that thereafter said capacitor (C1) outputs said single negative pulse signal by discharging said capacitor (C1) to zero.

22. An alarm device as recited in claim 21 in which said "normal function" detecting circuit comprises a photoelectric coupler (U1) for isolating high voltage and low voltage, a transistor (Q2), a capacitor (C3) for anti-interference, and four resistors (R4) (R5) (R8) (R9), wherein to input ends of said photoelectric coupler (U1) are connected in series with said resistors (R8) (R9) and two terminals (P1) (P2) respectively, said two output ends of said photoelectric coupler (U1) being connected in series with said resistor (R4) which is further connected to a terminal (B) of said transistor (Q2), said resistor (R5) connecting to a terminal (C) of said transistor (Q2) and said in-house signal indicator, said capacitor (C3) being connected to both said terminal (C) and a terminal (E) of said transistor Q2, said two terminals (P1) (P2) being connected to said garage door "normal operation" signal generating source, so that once said garage door is opened by operating said garage door opening machine, said "normal function" detecting circuit detects same and outputs said alarm inhibit signal to said central controlling circuit, said photoelectric coupler (U1) preventing an electrical connection between said 110 V high voltage of said garage door opening machine and said low voltage of said alarm device so as to enable said "normal function" detecting circuit to be activated through a small current of 0.2–0.3 μA, whereby when said garage door is opened normally by said garage door opening machine, a "normal opening" signal current is received by said photoelectric coupler (U1), and said photoelectric coupler (U1) electrically conducts to said terminal (E) and terminal (C) of said transistor (Q2) so as to feed a negative electrical signal to a first terminal of said integrated circuit (IC1) to inhibit the function thereof, so that said alarm generator does not provide warning alarm.

23. An alarm device as recited in claim 22 in which said central controlling circuit further comprises a resistor (R3) connected to a second terminal of said integrated circuit (IC1) which is an alarm activating terminal, a diode (D6) connected in parallel with said resistor R3 whereby said diode (D6) incorporates with said resistor (R3) to provide an anti-interference function, a relay (J1) connected to a third terminal of said integrated circuit (IC1) which is a positive potential difference output terminal after activation for activating said relay (J1) to enable said alarm generator to provide said warning alarm, a diode (D7) connected in parallel with said relay (J1), wherein said first terminal of said integrated circuit (IC1) which is connected to said terminal (C) of said transistor (Q2) is a negative potential difference input receiving terminal when said garage door is opened normally in order to prevent an alarm activation from said detecting circuit (A10), and that a capacitor (C4) is connected to a fourth terminal of said integrated circuit (IC1) to provide an anti-oscillating and anti-bypass effect, a fifth terminal and a sixth terminal of said integrated circuit (IC1) being connected to a capacitor (C5) and a resistor (R6) to provide said delay function for controlling said predetermined period of alarm time of said warning alarm generated by said alarm generator, whereby when said integrated circuit (IC1) is activated, said sixth terminal is inhibited and said resistor (R6) starts to charge said capacitor (C5), and that when a potential difference between said fifth terminal and said sixth terminal rises to a value equal to two-thirds of a potential difference of an in-house power source, said sixth terminal conducts for discharging to said capacitor (C5) so as to control said warning alarm generated by said alarm generator for 3–5 minutes, moreover, a seventh terminal of said integrated circuit (IC1) is grounded and an eighth terminal of said integrated circuit (IC1) acting as a VCC positive electricity input terminal.

24. An alarm device as recited in claim 23 in which said central controlling circuit further comprises a normally open switch (K1) which is activated to close by said relay (J1) so as to activate said alarm generator to provide an alarm sound, and a normally closed switch (K2) which is connected with at least an alarm generator of an in-house main system installed in said resident house and is activated to open by said relay (J1) so as to activate said in-house main alarm system.

25. An alarm device as recited in claim 24 in which said transformer circuit comprises a rectifier constituted by four diodes (Dl) (D2) (D3) (D4) and connected with a transformer which transforms in-house power to 12 VAC, a capacitor (C6) connected in series with said alarm generator and a diode (D5), a resistor (R7) connected in series with said diode (D5) and said rectifier, and a 1.5 mA and 12 VDC rechargeable battery connected in parallel with said rectifier, whereby said rectifier rectifies said 12 VAC voltage from said transformer to 12 VDC voltage for supplying said entire alarm circuit and recharging said 12 VDC rechargeable battery, and said capacitor (C6) is a filter capacitor with high capacity and said rechargeable battery provides a temporary power supply for a predetermined period of time when said in-house power fails.

* * * * *